US005516167A

United States Patent [19]

Hayakawa et al.

[11] Patent Number: 5,516,167

[45] Date of Patent: May 14, 1996

[54] VEHICLE DOOR LOCK APPARATUS

[75] Inventors: Shigeru Hayakawa; Nozomu Torii; Masao Ohhashi, all of Aichi, Japan

[73] Assignee: Aisin Seiki Kabushiki Kaisha, Kariya, Japan

[21] Appl. No.: 253,259

[22] Filed: Jun. 2, 1994

[30] Foreign Application Priority Data

Jun. 4, 1993 [JP] Japan ..... 5-134619
Sep. 29, 1993 [JP] Japan ..... 5-243052

[51] Int. Cl.[6] ..... E05C 3/26

[52] U.S. Cl. ..... 292/337; 292/201; 292/DIG. 23

[58] Field of Search ..... 292/201, 216, 292/337, 336.3, DIG. 23

[56] References Cited

U.S. PATENT DOCUMENTS 4,775,176 10/1988 Ikeda ..... 292/337
4,814,557 3/1989 Kato ..... 200/61.64
4,904,006 2/1990 Hayakawa et al. ..... 292/336.3
4,926,707 5/1990 Yamada ..... 292/201
5,035,454 7/1991 Fukumoto et al. ..... 292/337
5,261,711 11/1993 Mizuki et al. ..... 292/201

FOREIGN PATENT DOCUMENTS 62-25684 2/1987 Japan .
2-30874 2/1990 Japan .

*Primary Examiner*—Steven N. Meyers
*Assistant Examiner*—Tuyet-Phuong Pham
*Attorney, Agent, or Firm*—Burns, Doane, Swecker & Mathis

[57] ABSTRACT

A vehicle door lock apparatus includes a latch mechanism, a locking lever which permits the latch mechanism to be operated and prevents the latch mechanism from being operated and detecting member connected with the locking lever including a detecting shaft, wherein the locking lever is rotatably supported on the detecting shaft and the locking lever is rotated with the detecting member integrally about the detecting shaft.

14 Claims, 9 Drawing Sheets

VEHICLE DOOR LOCK APPARATUS

BACKGROUND OF THE INVENTION

1. Field of the Invention

This invention relates to a door lock apparatus, in particular relates to a vehicle door lock apparatus.

2. Description of the Related Art

A conventional vehicle door lock apparatus is disclosed in the Japanese Patent Laid Open No. 62(1987)-25684 and No. 2(1990)-30874. The vehicle door lock apparatus disclosed in the former comprises a locking lever which permits a latch mechanism to be operated and prevents the latch mechanism from being operated. The vehicle door lock apparatus further comprises detecting means which detects a condition of the locking lever. The locking lever is rotatably supported on a housing storing the latch mechanism through a pivotal shaft. Further, the detecting means is fixed on the housing. A detecting member of the detecting means, which is a different member from the pivotal shaft, is fit into a longitudinal slot of the locking lever so as to be connected with the locking lever.

On the other hand, the vehicle door lock apparatus disclosed in the latter comprises a locking lever which permits a latch mechanism to be operated and prevents the latch mechanism from being operated and an actuator which drives the locking lever. The vehicle door lock apparatus further comprises detecting means detecting a condition of the locking lever. The locking lever is rotatably supported on a housing storing the actuator through an output shaft of the actuator. Further, the detecting means is fixed on the housing, and a detecting member of the detecting means, which is a different member from the output shaft, is fitted into a longitudinal slot of the locking lever so as to be connected with the locking lever. Further, a wiring which is used for supplying an electric power to the actuator is connected with a controller, and other wiring which is used for transmitting a signal from the detecting means is connected with a controller.

However in accordance with the prior arts, since the detecting member of the detecting means is a different member from the pivotal shaft supporting the locking lever, the vehicle door lock apparatuses contain an increased number of parts and are difficult to be assembled. Further, the detecting means can not strictly detect the condition of the locking lever because of the variation of the location of the members which are assembled.

Especially, in accordance with the vehicle door lock apparatus disclosed in the latter, because the wiring which is used for supplying the electric power to the actuator is a different part from other wiring which is used for transmitting the signal from the detecting means, it is too complex to wire the wirings.

SUMMARY OF THE PRESENT INVENTION

It is an object of the present invention to provide a vehicle door lock apparatus which can be easily assembled.

It is another object of the present invention to provide a vehicle door lock apparatus including detecting means which can strictly detect a condition of a locking lever.

It is a further object of the present invention to provide a vehicle door lock apparatus which comprises durability.

It is a further object of the present invention to provide a vehicle door lock apparatus which is simple in structure and small in size.

It is a further object of the present invention to provide a vehicle door lock apparatus which is low in cost.

To achieve the above mentioned objects, a vehicle door lock apparatus in accordance with this invention comprises a latch mechanism, a locking lever which permits the latch mechanism to be operated and prevents the latch mechanism from being operated and detecting means connected with the locking lever including a detecting shaft, wherein the locking lever is rotatably supported on the detecting shaft and the locking lever is rotated with the detecting means integrally about the detecting shaft.

BRIEF DESCRIPTION OF THE DRAWINGS

The features and advantages of the vehicle door lock apparatus according to the present invention will be more clearly appreciated from the following description in conjunction with the accompanying drawings wherein:

FIG. 8(*b*) is an exploded view in perspective of second detecting means of a second embodiment of a vehicle door lock apparatus in accordance with the present invention;

DETAILED DESCRIPTION OF PREFERRED EMBODIMENT OF THE INVENTION

Figure 1:
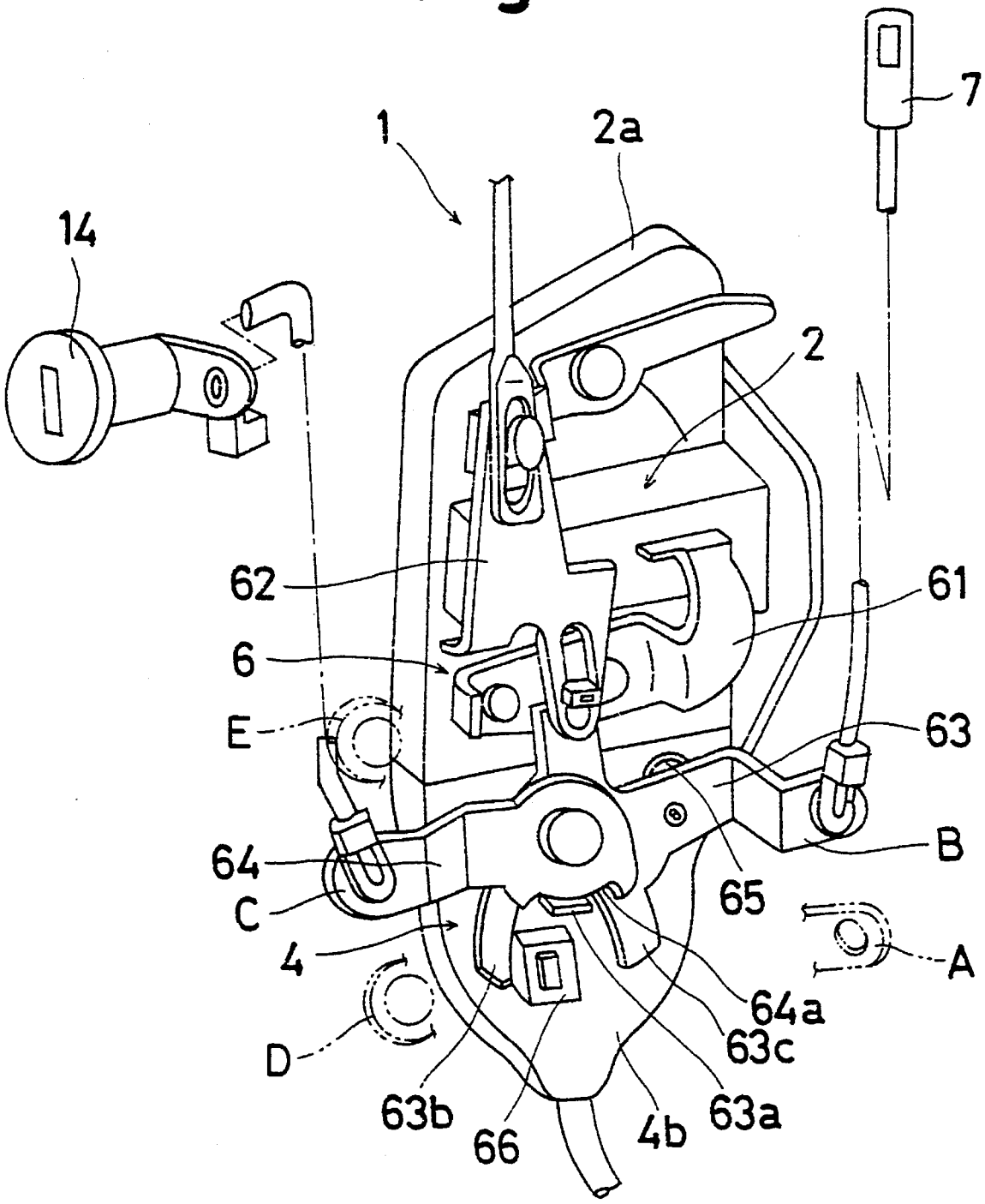
FIG. 1 is a perspective view of a first embodiment of a vehicle door lock apparatus in accordance with the present invention.

A first embodiment of a vehicle door lock apparatus in accordance with the invention will be described. Referring to the FIGS. 1 and 2, the vehicle door lock apparatus 1 comprises a latch mechanism 3, a switching mechanism 5 (shown specifically in FIG. 5) and a link mechanism 6. The latch mechanism 3 is disposed in a first housing 2 which is formed with a main body 2*a* and a cover (not shown in the FIGURES) so as to be located at a side of a vehicle door (not shown in the FIGURES). The switching mechanism 5 is disposed in a second housing 4, which is formed with a main body 4*a* (shown specifically in FIG. 4) and a case 4*b* and is fluid-tightly sealed from outside, so as to be located at a side of a vehicle door. The link mechanism 6 is disposed on the first and second housings 2, 4.

Figure 2:
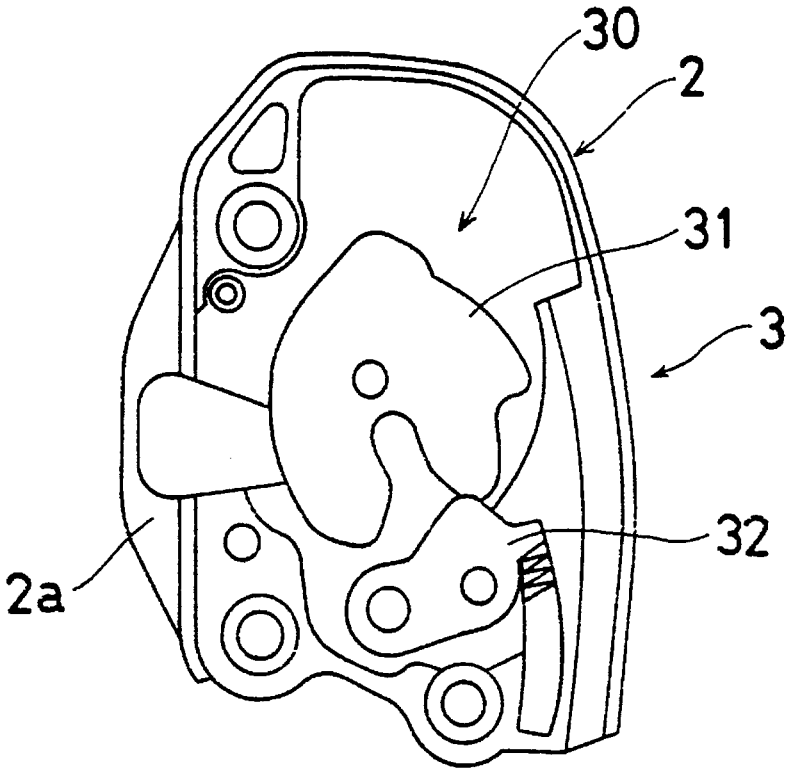
FIG. 2 is a plan view of a latch mechanism of a vehicle door lock apparatus in accordance with the present invention.

As shown in FIG. 2, the latch mechanism 3 is formed with a latch 31 and a pole 32. Both the latch 31 and the pole 32 are pivotably supported on the main body 2*a* of the first housing 2. The latch 31 is engaged and disengaged with a striker (not shown in the FIGURES) mounted on a vehicle body by opening and closing operations of the door. The pole 32 is engaged and disengaged with the latch 31 with a rotation thereof and the pole 32 is pivoted by an operation of the link mechanism 6 and the rotational operation of the latch 31. When the latch 31 is engaged with the pole 32, the vehicle door is kept in a closed condition (Latch Condition of the vehicle door lock apparatus 1). When the latch 31 is disengaged from the pole 32, the vehicle door is able to be opened and closed (Unlatch Condition of the vehicle door lock apparatus 1). The above mentioned structure and operations of the latch 31 and the pole 32 are conventional.

As shown in the FIG. 1, the link mechanism 6 is formed with a lift lever 61, an open lever 62, a knob locking lever 63 and a key locking lever 64. The lift lever 61 is pivotably supported on the main body 2*a* of the first housing 2 and is connected with the pole 32 so as to rotate the pole 32 with the rotational operation thereof. The open lever 62 is movable up and down and swingably supported on the main body 2*a* of the first housing 2. The open lever 62 is moved so as to be engaged and disengaged with the lift lever 61. Further, the open lever 62 is swung for engagement with and disengagement from the lift lever 61. The knob locking lever 63 is pivotably supported on the case 4*b* of the second housing 4 through a boss portion 41 (described later). The knob locking lever 63 is connected with the open lever 62 and is pivoted so as to swing the open lever 62. The key locking lever 64 is pivotably supported on the case 4*b* through a detecting member 51 (described later). The key locking lever 64 is connected with the knob locking lever 63 and is pivoted so as to swing the knob locking lever 63.

A flange 63*a* of the knob locking lever 63 is able to be engaged with a slot 64*a* of the key locking lever 64. The knob locking lever 63 can be rotated by rotational operation of the key locking lever 64, however, the key locking lever 64 can not be rotated by rotational operation of the knob locking lever 63.

When the lift lever 61 and the open lever 62 can be engaged and disengaged with each other, the latch mechanism 3 under the Latch Condition can move into the Unlatch Condition by the operation of the open lever 62 (Unlock Condition of the vehicle door lock apparatus 1). When the lift lever 61 and the open lever 62 can not be engaged and disengaged with each other, the latch mechanism 3 under the Latch Condition can not be moved into the Unlatch Condition by the operation of the open lever 62 (Lock Condition of the vehicle door lock apparatus 1).

The open lever 62 is connected with an inside handle and an outside handle (Both of them are not shown in the FIGURES.) mounted on the vehicle door through a link or a lever. Further, the knob locking lever 63 is connected with a knob 7 mounted on the vehicle door through a link or a lever and the key locking lever 64 is connected with a key cylinder 14 mounted on the vehicle door through a link or a lever.

A turn over spring 65 and a stopper member 66 are disposed between the knob locking lever 63 and the case 4*b*. When the knob locking lever 63 is located at the Unlock Position B (shown as a solid line in the FIG. 1) corresponding to the Unlock Condition of the vehicle door lock apparatus 1, the rotational operation of the knob locking lever 63 is restricted to be rotated by a contact of a foot portion 63*b* thereof and the stopper 66 and the knob locking lever 63 is biassed by the turn over spring 65. On the other hand, when the knob locking lever 63 is located at Lock Position A (shown as a one-dotted line in the FIG. 1) corresponding to the Lock Condition of the vehicle door lock apparatus 1, the rotational operation of the knob locking lever 63 is restricted to be rotated by a contact of the other foot portion 63*c* thereof and the stopper 66. Further, the key locking lever 64 is selectively switched by an operation of the key cylinder 14 to be located at the Unlock Position D (shown as a two-dotted line in the FIG. 1) corresponding to the Unlock Condition of the vehicle door lock apparatus 1, Lock Position E (shown as a one-dotted line in the FIG. 1) corresponding to the Lock Condition of the vehicle door lock apparatus 1 and Initial Position C (shown as a solid line in the FIG. 1). The above mentioned structure and operations of the lift lever 61, the open lever 62, the knob locking lever 63 and the key locking lever 64 are conventional.

Figure 4:
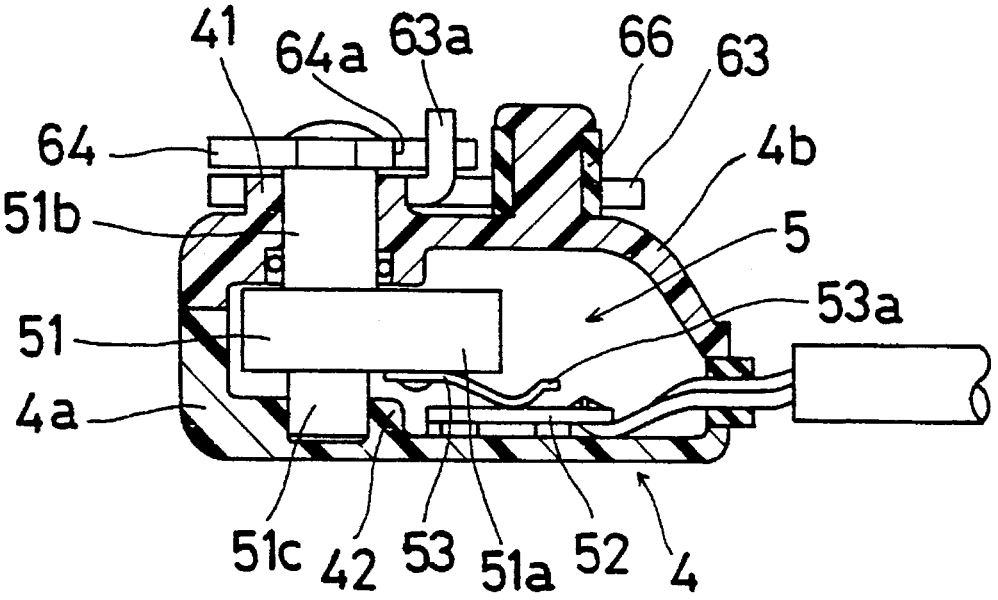
FIG. 4 is a sectional view of detecting means of a first embodiment of a vehicle door lock apparatus in accordance with the present invention.
Figure 3:
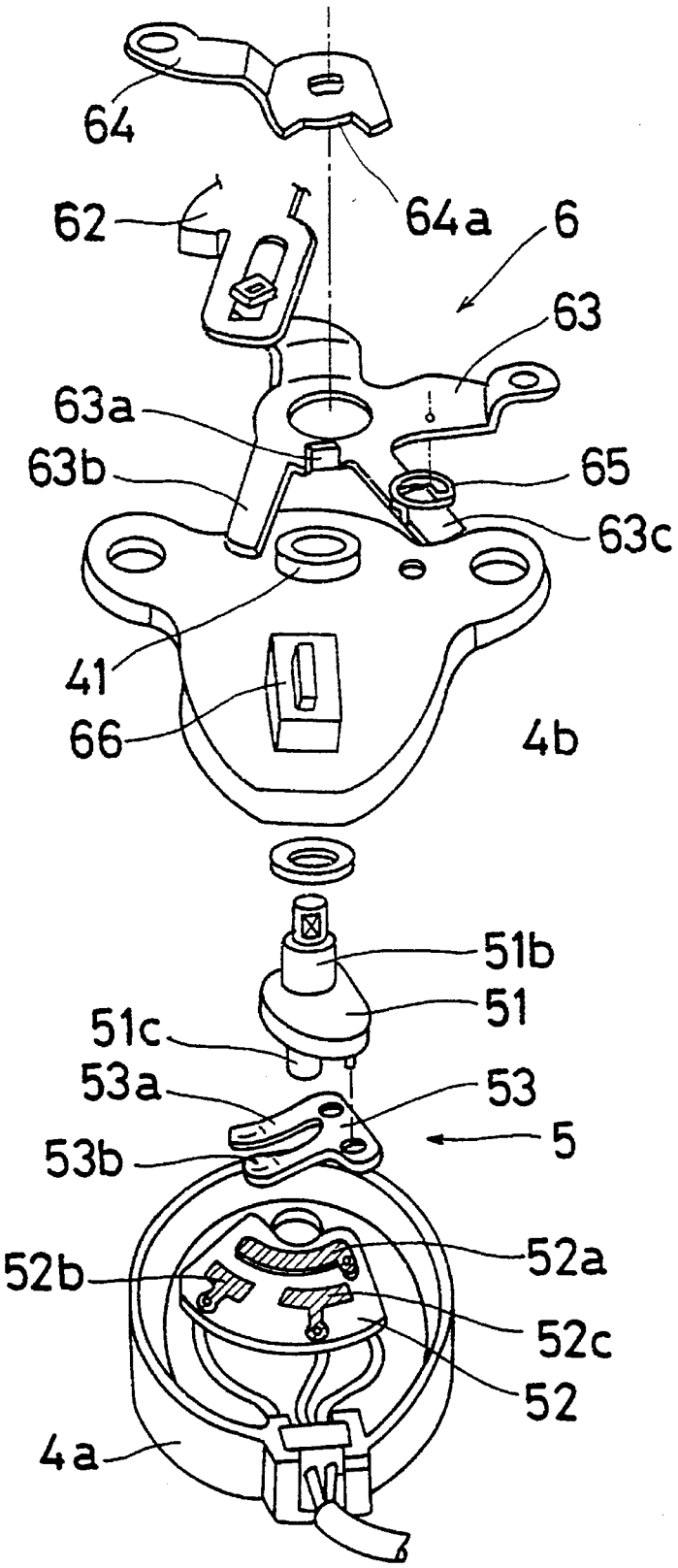
FIG. 3 is an exploded view in perspective of detecting means of a first embodiment of a vehicle door lock apparatus in accordance with the present invention.

As shown in the FIGS. 3 and 4, a switch mechanism 5 is formed with a detecting member 51, a substrate 52 and a brush 53. The detecting member 51 includes a base body 51*a*, a detecting shaft 51*b* and a supporting shaft 51*c* integrally. The detecting member 51 is rotatably supported on the boss portions 41 and 42 each of which is formed on the case 4*b* and main body 4*a* of the second housing 4, respectively, through the detecting shaft 51*b* and the supporting shaft 51*c*. The detecting shaft 51*b* is exposed to the outside of the second housing 4 through the boss portion 41. The key locking lever 64 of the link mechanism 6 is fixed on a tip of the detecting shaft 51*b* so as to be rotatable with the detecting shaft 51*b* integrally. Further, the boss portion 41 is projects out of the outer surface of the case 4*b* and the knob locking lever 63 is rotatably supported around the boss portion 41. The brush 53 is fixed on the base body 51*a* by screws. The brush 53 includes a first contact portion 53*a* and a second contact portion 53*b*.

The substrate 52 is fixed on the main body 4*a* by screws. The substrate 52 includes a first print contact portion 52*a* which is contacted with the first contact portion 53*a* and a second print contact portion 52*b* and a third contact portion 52*c* each of which is contacted with the second contact portion 53*b*. In accordance with the above structure, when the first contact portion 53*a* of the brush 53 is contacted with the first print contact portion 52*a* of the substrate 52 and the second contact portion 53*b* of the brush 53 is contacted with the second print contact portion 52*b* of the substrate 52, the first print contact portion 52*a* is electrically connected with the second print contact portion 52*b* in order to detect the Lock Position E of the key locking lever 64. On the other hand, when the first contact portion 53*a* of the brush 53 is contacted with the first print contact portion 52*a* of the substrate 52 and the second contact portion 53*b* of the brush 53 is contacted with the third print contact portion 52*c* of the substrate 52, the first print contact portion 52*a* is electrically connected with the third print contact portion 52*c* in order to detect the Unlock Position B of the key locking lever 64. The first contact portion 53*a* of the brush 53 is usually contacted with the first print contact portion 52*a* regardless of the position of the key locking lever 64. Further, when the key locking lever 64 is located at the Initial Position C, the second contact portion 53*b* of the brush 53 is contacted with a portion of the substrate 52 which is positioned between the second print contact portion 52*b* and the third print contact portion 52*c*.

An operation of the vehicle door lock apparatus 1 will be described hereinafter. As shown in FIGS. 1 and 2 with the solid line, the vehicle door lock apparatus 1 is under the Unlock Condition and the Latch Condition (Close Condition of the vehicle door). When one of the inside handle and the outside handle is operated, the open lever 62 is moved down (shown in FIGS. 1 and 2). Therefore, the open lever 62 and the lift lever 61 engage each other and the lift lever 61 is rotated. Consequently, the pole 32 is pivoted therefore the latch 31 is disengaged with the pole 32 (the Unlatch Condition which permits the vehicle door to be opened and closed). On the other hand, when the vehicle door under the Open Condition is moved to the Close Condition, the vehicle door lock apparatus 1 under the Unlatch Condition is automatically switched into the Latch Condition.

As shown in FIG. 1 with the solid line, the vehicle door lock apparatus 1 is under the Unlock Condition. When the knob 7 is moved down, the knob locking lever 63 is pivoted in the clockwise direction (shown in the FIG. 1) about the detecting shaft 51*b* in order that the foot portion 63*c* is contacted with the stopper 66. At this time the knob locking lever 63 is forced by the elastic force of the turn over spring 65 so as to be positioned at the Lock Position A and the open lever 62 is swung. Therefore, the open lever 62 is positioned not to be able to be engaged and disengaged with the lift lever 61 (the Lock Condition). At this moment the key locking lever 64 is not rotated with the knob locking lever 63 because of a gap between the flange 63*a* and the slot 64*a*.

On the other hand, as shown in the FIG. 1 with the one-dotted line, the vehicle door lock apparatus 1 is in the Lock Condition. When the knob 7 is moved up, the knob locking lever 63 is pivoted in the counter-clockwise direction (shown in the FIG. 1) about the detecting shaft 51*b* in order that the foot portion 63*b* is contacted with the stopper 66. At this time the knob locking lever 63 is forced by the elastic force of the turn over spring 65 so as to be positioned at the Unlock Position B and the open lever 62 is swung. Therefore, the open lever 62 is positioned to be able to be engaged and disengaged with the lift lever 61 (the Unlock Condition). At this moment the key locking lever 64 is not also rotated with the knob locking lever 63 because of a gap between the flange 63*a* and the slot 64*a*.

As shown in the FIG. 1 with the solid line, the vehicle door lock apparatus 1 is under the Unlock Condition. When the key cylinder 14 is operated in one direction, the key locking lever 64 is pivoted in the clockwise direction (shown in the FIG. 1) about the detecting shaft 51*b* with the detecting member 51 so as to be positioned at the Lock Position E. Therefore, the knob locking lever 63 is also rotated in the clockwise direction (shown in the FIG. 1) about the boss portion 41 by the engagement of the flange 63*a* and the slot 64*a* in order that the foot portion 63*c* is contacted with the stopper 66. At this time the knob locking lever 63 is forced by the elastic force of the turn over spring 65 so as to be positioned at the Lock Position A and the open lever 62 is swung. Therefore, the open lever 62 is positioned not to be able to be engaged and disengaged with the lift lever 61 (the Lock Condition). At this moment because the detecting member 51 is pivoted with the key locking lever 64, the second contact portion 53*b* of the brush 53 is contacted with the third print contact portion 52*c* of the substrate 52. Therefore, the first print contact portion 52*a* is electrically connected with the third print contact portion 52*c* so as to detect the Lock Portion E of the key locking lever 64. Therefore, the Lock Condition of the vehicle door lock apparatus 1 is detected.

When the operation of the key cylinder 14 is released, the key locking lever 64 is forced by the elastic force of the key cylinder 14 so as to be returned to the Initial Position C. The detecting member 51 is also returned to the position where the second contact portion 53*b* of the brush 53 is not contacted with the second print contact portion 52*b* and the third print contact portion 52*c* of the substrate 52.

When the key cylinder 14 is operated in the other direction under the Lock Condition, the key locking lever 64 is pivoted in the counter-clockwise direction (shown in the FIG. 1) about the detecting shaft 51*b* with the detecting member 51 so as to be positioned at the Unlock Position D. Therefore, the knob locking lever 63 is also rotated in the counter-clockwise direction (shown in the FIG. 1) about the boss portion 41 by the engagement of the flange 63*a* and the slot 64*a* in order that the foot portion 63*b* is contacted with the stopper 66. At this time the knob locking lever 63 is forced by the elastic force of the turn over spring 65 so as to be positioned at the Unlock Position B and the open lever 62 is swung. Therefore, the open lever 62 is positioned to be able to be engaged and disengaged with the lift lever 61 (the Unlock Condition). At this moment because the detecting member 51 is pivoted with the key locking lever 64, the second contact portion 53*b* of the brush 53 is contacted with the second print contact portion 52*b* of the substrate 52. Therefore, the first print contact portion 52*a* is electrically connected with the second print contact portion 52*b* so as to detect the Unlock Position D of the key locking lever 64. Therefore, the Unlock Condition of the vehicle door lock apparatus 1 is detected. When the operation of the key cylinder 14 is released, the key locking lever 64 is forced by the elastic force of the key cylinder 14 so as to be returned to the Initial Position C. The detecting member 51 is also returned to the position where the second contact portion 53*b* of the brush 53 is not contacted with the second print contact portion 52*b* and the third print contact portion 52*c* of the substrate 52.

Figure 8A:
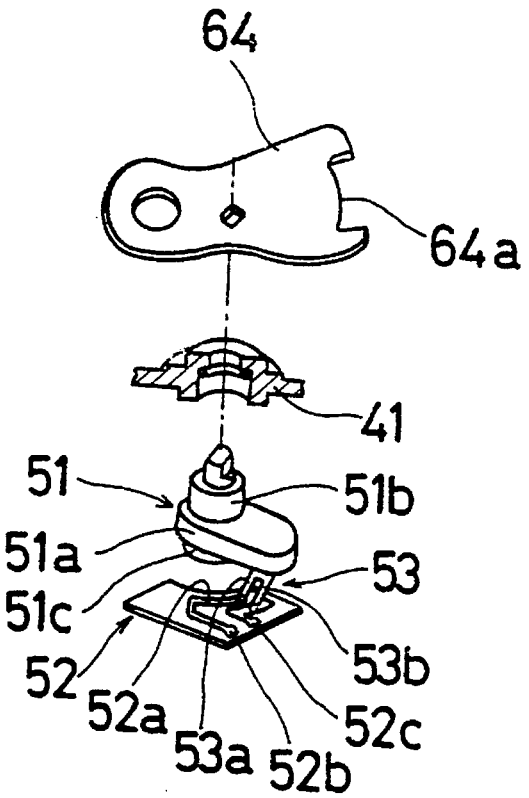
FIG. 8(*a*) is an exploded view in perspective of first detecting means of a second embodiment of a vehicle door lock apparatus in accordance with the present invention.
Figure 8B:
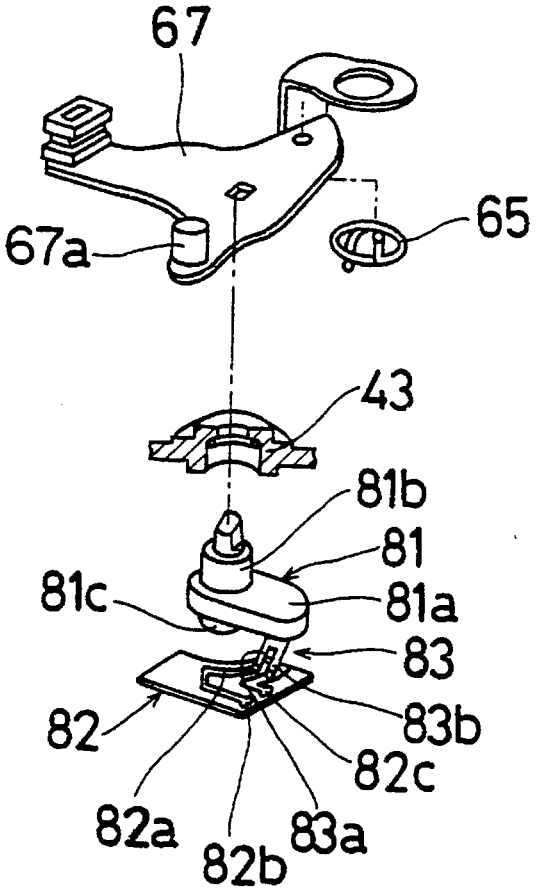
Figure 9:
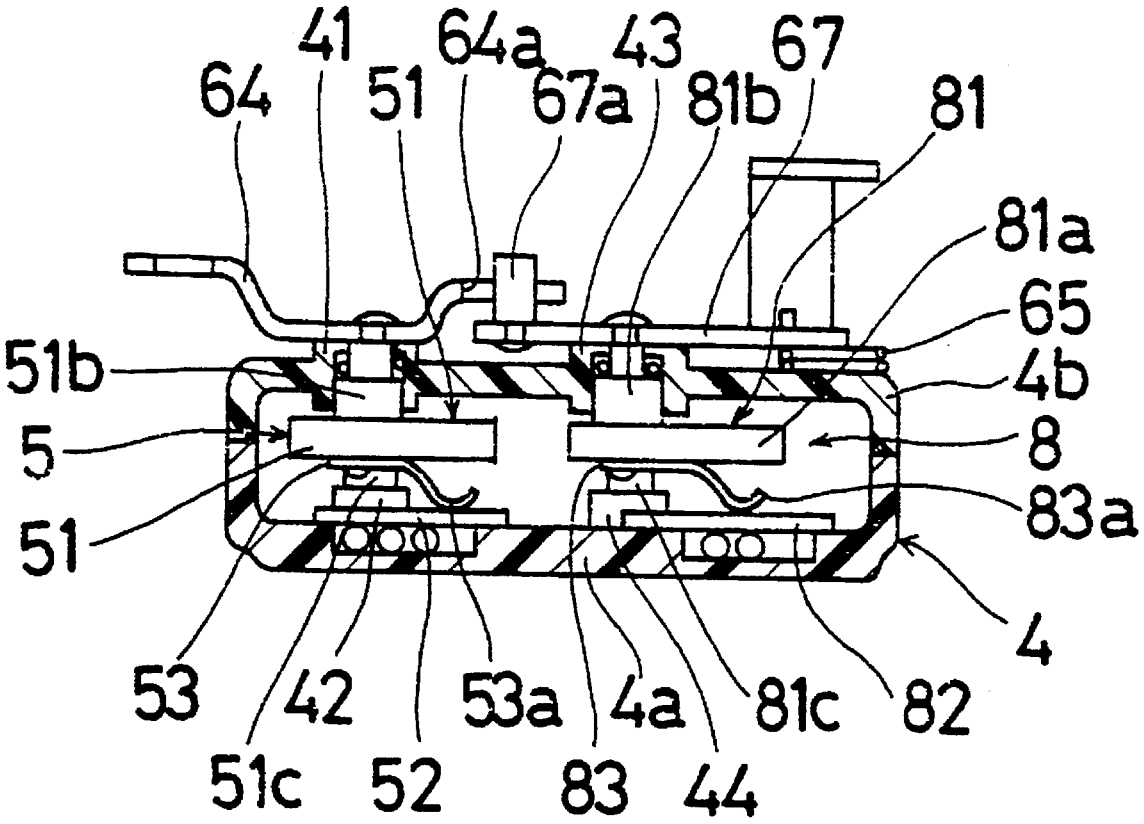
FIG. 9 is a sectional view of detecting means of a second embodiment of a vehicle door lock apparatus in accordance with the present invention.

A second embodiment of the vehicle door lock apparatus in accordance with the invention will be described hereinafter. As shown in the FIGS. 8(*a*), 8(*b*) and 9, the switching mechanisms 5, 8 are formed with the detecting members 51, 81, the substrates 52, 82 and the brushes 53, 83. The detecting members 51, 81 respectively include the base bodies 51*a*, 81*a*, the detecting shafts 51*b*, 81*b* and the supporting shafts 51*c*, 81*c* which are formed integrally with each other. The detecting members 51, 81 are rotatably supported on the boss portions 41, 43 formed on the case 4*b* and the boss portions 42, 44 formed on the main body 4*a* respectively. Further, the detecting shafts 51*b*, 81*b* are respectively exposed to the outside of the second housing 4 through the boss portions 41, 43. The key locking lever 64 of the link mechanism 6 is mounted on the tip of the detecting shaft 51*b* so as to be rotated with the detecting member 51 integrally. An actuator locking lever 67 (corresponding to the knob locking lever 63 of the first embodiment) of the link mechanism 6 is mounted on the tip of the detecting shaft 81*b* so as to be rotated with the detecting member 81 integrally.

The brushes 53, 83 are fixed on the base bodies 51*a*, 81*a* by screws. The brushes 53, 83 respectively include the first contact portions 53*a*, 83*a* and the second contact portions 53*b*, 83*b*. The substrates 52, 82 respectively include the first print contact portions 52*a*, 82*a* which are contacted with the first contact portions 53*a*, 83*a* of the brushes 53, 83, the second print contact portions 52*b*, 82*b* and the third print contact portions 52*c*, 82*c* which are contacted with the second contact portions 53*b*, 83*b*.

In accordance with the above structure, when the first contact portion 53*a* of the brush 53 is contacted with the first print contact portion 52*a* of the substrate 52 and the second contact portion 53*b* of the brush 53 is contacted with the second print contact portion 52*b* of the substrate 52, the first print contact portion 52*a* is electrically connected with the second print contact portion 52*b* so as to detect the Lock Position E of the key locking lever 64.

To the contrary, when the first contact portion 53*a* of the brush 53 is contacted with the first print contact portion 52*a* of the substrate 52 and the second contact portion 53*b* of the brush 53 is contacted with the third print contact portion 52*c* of the substrate 52, the first print contact portion 52*a* is electrically connected with the third print contact portion 52*c* so as to detect the Unlock Position D of the key locking lever 64.

On the other hand, when the first contact portion 83*a* of the brush 83 is contacted with the first print contact portion 82*a* of the substrate 82 and the second contact portion 83*b* of the brush 83 is contacted with the second print contact portion 82*b* of the substrate 82, the first print contact portion 82*a* is electrically connected with the second print contact portion 82*b* so as to detect the Lock Position A of the actuator locking lever 67.

To the contrary, when the first contact portion 83*a* of the brush 83 is contacted with the first print contact portion 82*a* of the substrate 82 and the second contact portion 83*b* of the brush 83 is contacted with the third print contact portion 82*c* of the substrate 82, the first print contact portion 82*a* is electrically connected with the third print contact portion 82*c* so as to detect the Unlock Position B of the actuator locking lever 67.

Figure 5:
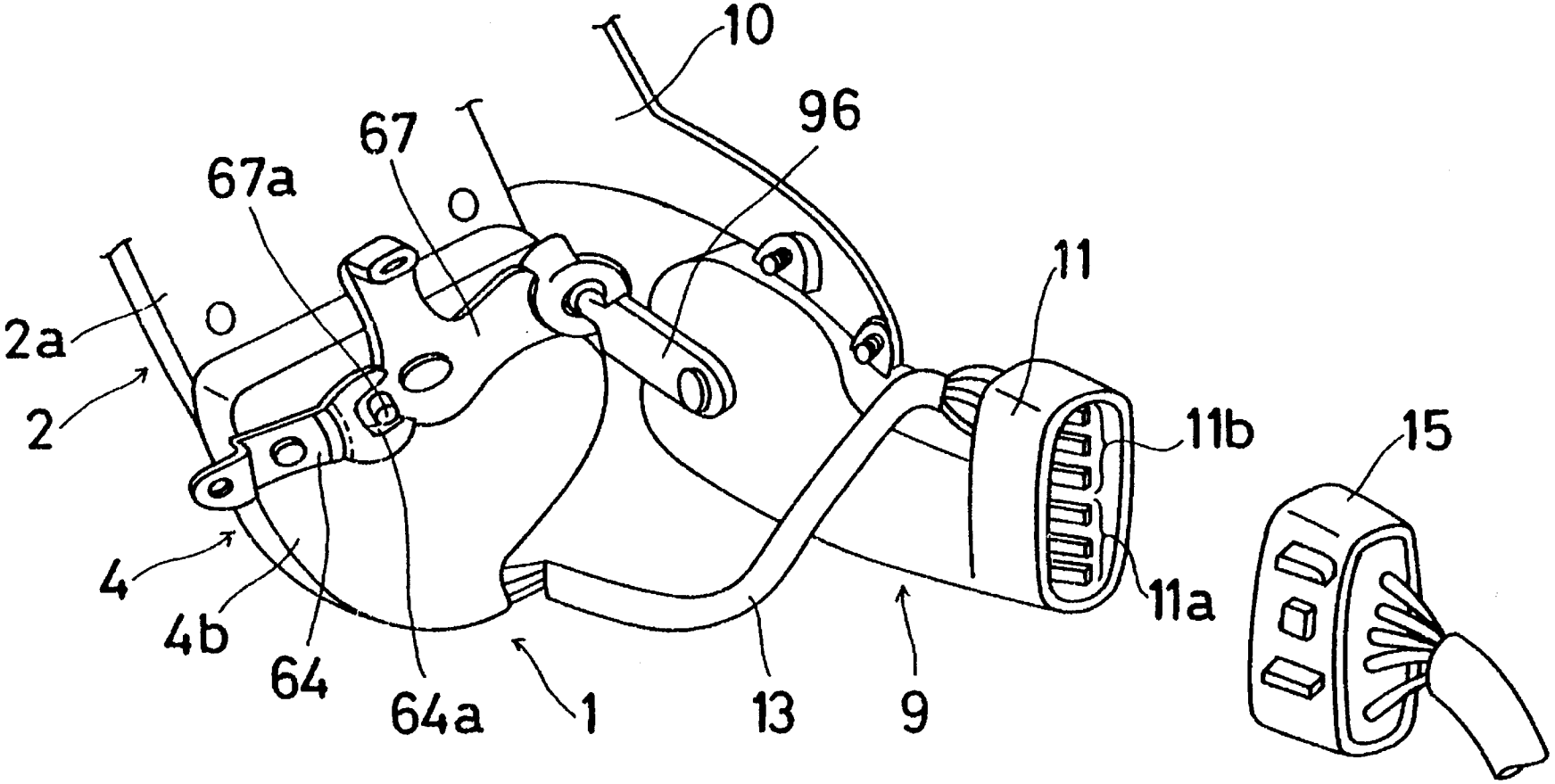
FIG. 5 is a perspective view of a second embodiment of a vehicle door lock apparatus in accordance with the present invention.
Figure 10:
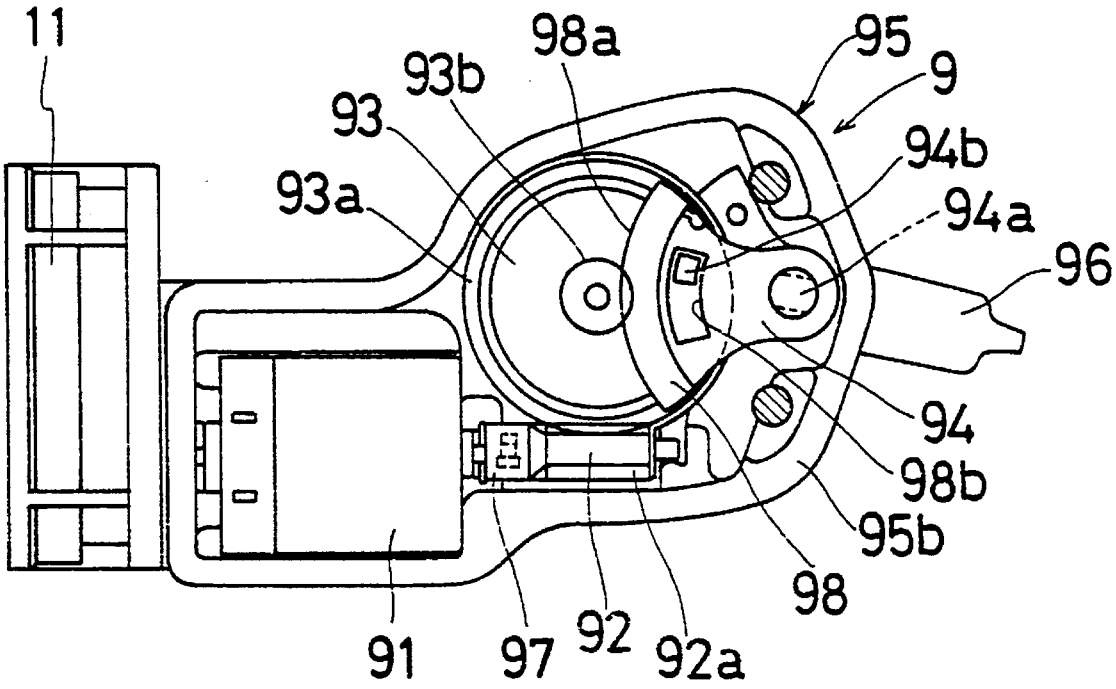
FIG. 10 is a plan view of an actuator of a vehicle door lock apparatus in accordance with the present invention.
Figure 11:
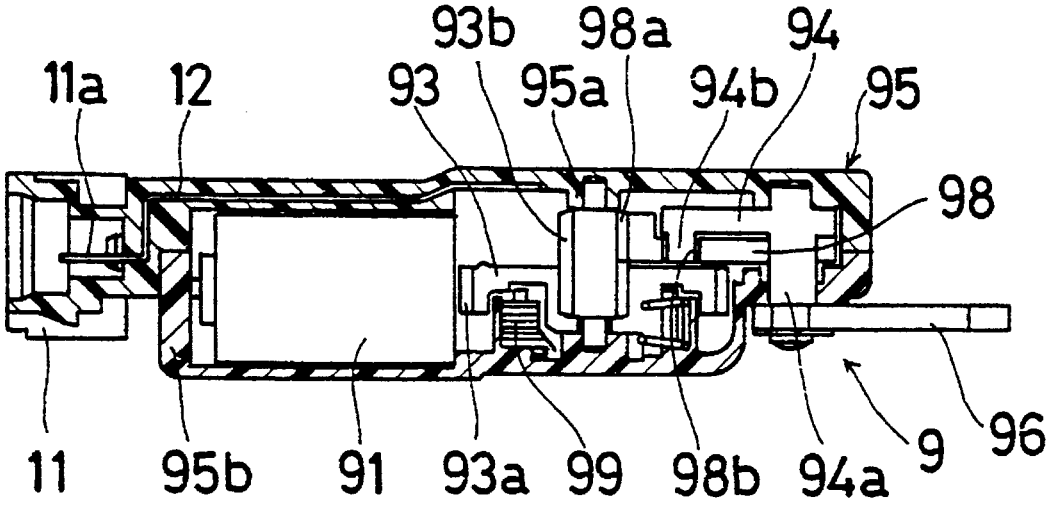
FIG. 11 is a sectional view of an actuator of a vehicle door lock apparatus in accordance with the present invention shown in the FIG. 10.

As shown in FIG. 5, the actuator locking lever 67 is connected with an output lever 96 of an actuator 9 which is fixed on the main body 2*a* of the first housing 2. As shown in FIGS. 10 and 11, the actuator 9 is formed with a motor 91, a worm gear 92, a wheel gear 93, a first output member 94, a second output member 98 and an output lever 96. The actuator 9 is disposed in a housing 95 which is fluid-tightly formed with a main body 95*a* and a cover 95*b*. The worm gear 92 is rotatably mounted on the cover 95*b* and is connected with an output shaft of the motor 91 through a connecting member 97 so as to be rotated with the output shaft of the motor 91 integrally. The wheel gear 93 is rotatably mounted on the main body 95*a* and the cover 95*b*. A teeth portion 93*a* of the wheel gear 93 is engaged with a teeth portion 92*a* of the worm gear 92. Therefore, it is possible to transmit a rotational torque in one direction from the worm gear 92 to the wheel gear 93 and further that of the counter-direction. The first output member 94 is rotatably mounted on the main body 95*a* and the cover 95*b*. A shaft portion 94*a* of the first output member 94 is exposed outside of the housing 95 through the cover 95*b* and is connected with the output lever 96. The second output member 98 is rotatably supported on the shaft portion 94*a* of the first output member 94. A teeth portion 98*a* of the second output member 98 is engaged with the teeth portion 93*b* of the wheel gear 93. Further, a longitudinal slot 98*b* of the second output member 98 which is an arc-shaped configuration about the shaft portion 94*a* is connected with a convex portion 94*b* of the first output member 94. A coil spring 99 is disposed between the wheel gear 93 and the cover 95*b*. The wheel gear 93 and the second output member 98 are biassed from the coil spring 99 so as to be returned to the initial positions thereof.

A connecter 11 is integrally formed on the main body 95*a* of the housing 95. The connecter 11 includes an input terminal 11*a* of the motor 91 which is connected with the motor 91 through a reed wiring 12 and an output terminal 11*b* of the switching mechanisms 5, 8 which is connected with the substrates 52, 82 through a reed wiring 13. The reed wiring 12 is formed in the main body 95*a* by an insert molding. The connecter 11 is connected with other connecter 15 which is connected with a controller. In accordance with the above structure, since wirings 12, 13 which transmit the signals from the switch mechanisms 5, 8 and supply the electric power to the actuator 9 are connected with the connecter 11, it is easy to wire the wirings. Further the vehicle door lock apparatus 1 can be easily assembled.

An operation of the second embodiment of the vehicle door lock apparatus will be described hereinafter. As shown in the FIG. 6 with the solid line, under the Unlock Condition of the vehicle door lock apparatus 1 when the key locking lever 64 is rotated in the counter-clockwise direction (shown in the FIG. 6) about the detecting shaft 51*b* with the detecting member 51 so as to be positioned at the Lock Position E, the actuator locking lever 67 is rotated in the clockwise direction (shown in the FIG. 6) about the detecting shaft 81*b* with the detecting member 81 by the engagement of a pin 67*a* and the slot 64*a* so as to be maintained at the Lock Position A by the elastic force of the turn over spring 65. Therefore the open lever 62 is swung to a position in which it is not able to engage with the lift lever 61 (the Lock Condition of the vehicle door lock apparatus 1). At this time the detecting members 51, 81 are also rotated with the key locking lever 64 and the actuator locking lever 67. Therefore, since the second contact portions 53*b*, 83*b* of the brushes 53, 83 are respectively contacted with the third print contact portions 52*c*, 82*c* of the substrates 52, 82, the first print contact portions 52*a*, 82*a* are electrically connected with the third print contact portions 52*c*, 82*c* respectively so as to detect the Lock Position E of the key locking lever 64 and the actuator locking lever 67 (the Lock Condition of the vehicle door lock apparatus 1).

To the contrary, under the Lock Condition of the vehicle door lock apparatus 1 when the key cylinder 14 is rotated in the other directions, the key locking lever 64 is rotated in the clockwise direction and the actuator lever 67 is rotated in the counter-clockwise direction (shown in the FIG. 6) so as to be positioned at the Unlock Position B. Therefore the open lever 62 is swung so as to be positioned to be able to be engaged with the lift lever 61 (the Unlock Condition of the vehicle door lock apparatus 1). At this time the detecting members 51, 81 are also rotated with the key locking lever 64 and the actuator locking lever 67. Therefore, since the second contact portions 53*b*, 83*b* of the brushes 53, 83 are respectively contacted with the second print contact portions 52*b*, 82*b* of the substrates 52, 82, the first print contact portions 52*a*, 82*a* are electrically connected with the second print contact portions 52*b*, 82*b* respectively so as to detect the Unlock Position D of the key locking lever 64 and the actuator locking lever 67 (the Unlock Condition of the vehicle door lock apparatus 1). When the key cylinder 14 is rotated, the actuator 9 is not driven. However, the actuator locking lever 67 can be rotated by the rotational operation of the key locking lever 64 since the rotational torque can be transmitted from the wheel gear 93 to the worm gear 92.

Figure 6:
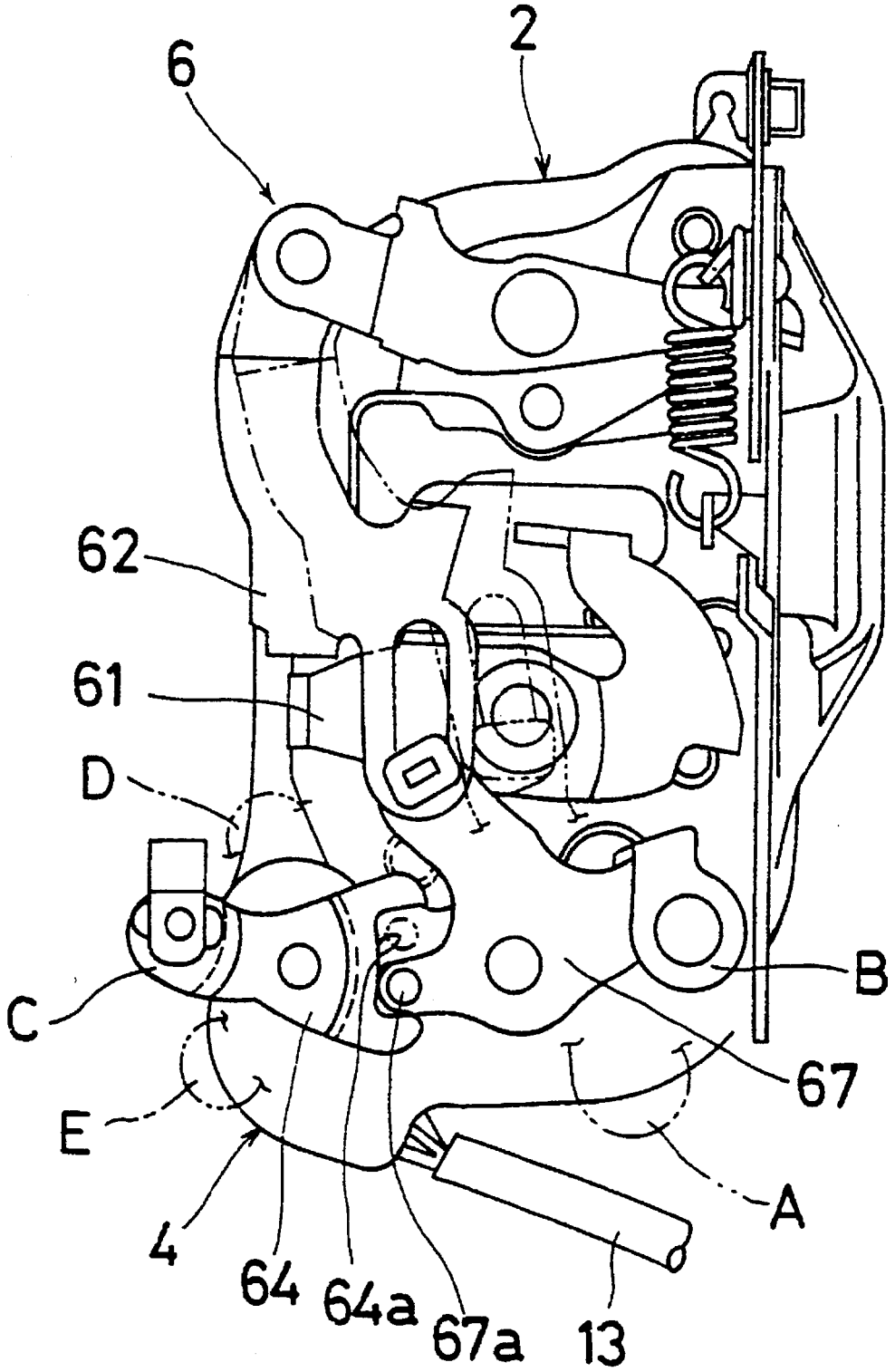
FIG. 6 is a plan view of a second embodiment of a vehicle door lock apparatus in accordance with the present invention.
Figure 7:
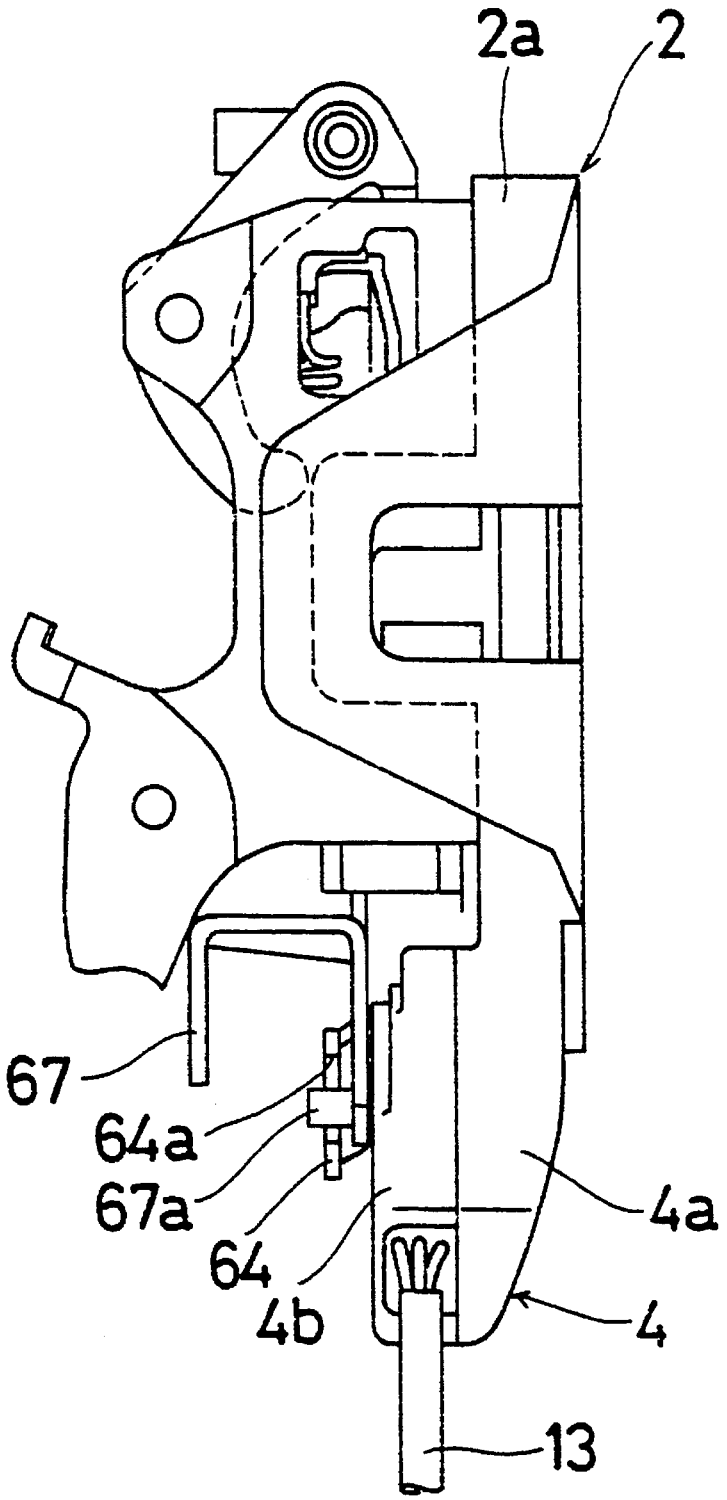
FIG. 7 is a side view of a vehicle door lock apparatus in accordance with the present invention shown in the FIG. 6.

As shown in the FIG. 6 with the solid line, the vehicle door lock apparatus 1 is under the Unlock Condition. When the motor 91 of the actuator 9 is operated, the output lever 96 is rotated through the worm gear 92, the wheel gear 93, the second output member 98 and the first output member 94. Therefore the actuator locking lever 67 is rotated in the clockwise direction (shown in the FIG. 6) about the detecting shaft 81*b* so as to be maintained at the Lock Position A by the elastic force of the turn over spring 65. Consequently, the open lever 62 is swung (the Lock Condition of the vehicle door lock apparatus 1). At this moment because the detecting member 81 is pivoted with the actuator locking lever 67, the second contact portion 83*b* of the brush 83 is contacted with the third print contact portion 82*c* of the substrate 82. Therefore, the first print contact portion 82*a* is electrically connected with the third print contact portion 82*c* so as to detect the Lock Position A of the actuator locking lever 67. Therefore, the Lock Condition of the vehicle door lock apparatus 1 is detected.

To the contrary, when the actuator 9 is driven in the counter-direction under the Lock Condition, the actuator locking lever 67 is rotated so as to be positioned at the Unlock Position B. Therefore, the open lever 62 is positioned to be able to be engaged with the lift lever 61 (the Unlock Condition of the vehicle door lock apparatus 1). At this moment because the detecting member 81 is pivoted with the actuator locking lever 67, the second contact portion 83*b* of the brush 83 is contacted with the second print contact portion 82*b* of the substrate 82. Therefore, the first print contact portion 82*a* is electrically connected with the second print contact portion 82*b* so as to detect the Unlock Condition of the vehicle door lock apparatus 1. When the actuator 9 is operated, the key locking lever 64 can not be rotated with the actuator locking lever 67 by a gap between the pin 67*a* and the slot 64*a*.

In accordance with the first and second embodiments, the signals to detect the Lock Condition and the Unlock Condition of the vehicle door lock apparatus 1 which are output from the switching mechanisms 5, 8 are used for operating the vehicle door lock apparatus 1 mounted on the vehicle. That is to say, the signals from the switching mechanisms 5, 8 are used as signals which operate a centralized vehicle door lock system. Further, other members of the second embodiment which are not mentioned above are the same as the corresponding members of the first embodiment.

In accordance with the invention, since the locking levers 64, 67 are respectively fixed on the detecting shafts 51*b*, 81*b* of the detecting members 51, 81, the detecting shafts 51*b*, 81*b* can also serve as the supporting structure of the locking levers 64, 67. Therefore, a supporting shaft used in the conventional door lock apparatus is not necessary. Consequently, the number of parts of the vehicle door lock apparatus are decreased. Furthermore, the construction of the engagement between the locking levers 64, 67 and the detecting members 51, 81 can be simple in order that the vehicle door lock apparatus can be easily assembled.

On the other hand, since the locking levers 64, 67 are directly mounted on the detecting shafts 51*b*, 81*b* so as to directly operate the detecting members 51, 81, the switching mechanisms 5, 8 can strictly detect the positions of the locking levers 64, 67. Further, because the switching mechanisms 5, 8 are disposed in the fluid-tightly sealed housing 4, the switching mechanisms 5, 8 are not exposed to the rain drop. Therefore, the switching mechanisms 5, 8 can be compact in size and high reliability.

While the invention has been particularly shown and described with reference to preferred embodiment thereof, it will be understood by those skilled in the art that the foregoing and other changes in form and details can be made therein without departing from the spirit and scope of the invention.

What is claimed is:

1. A vehicle door lock apparatus comprising:

a latch mechanism for establishing a latched condition of a vehicle door;

a rotatable key locking lever for being connected to a key cylinder of a vehicle for movement between an unlocked position in which operation of the latch mechanism is permitted and a locked position in which operation of the latch mechanism is prevented; and detecting means for detecting the locked or unlocked position of the key locking lever, the detecting means including a detecting shaft, the key locking lever being fixed in position on the detecting shaft so that rotation of the key locking lever directly results in rotation of the detecting shaft.

2. A vehicle door lock apparatus as recited in claim 1, wherein the detecting means is disposed in a fluid-tightly sealed housing.

3. A vehicle door lock apparatus as recited in claim 1, wherein the detecting shaft includes a first detecting shaft which detects the locked or unlocked position of the key locking lever.

4. A vehicle door lock apparatus as recited in claim 3, wherein the detecting means also includes a first brush and a second brush which are both rotatable together with the first detecting shaft, a first contact with which the first brush is in sliding engagement, a second contact, a third contact, and a space located between the second contact and the third contact, the second brush being in sliding engagement with each of the second contact, the third contact and the space during movement of the detecting shaft.

5. A vehicle door lock apparatus as recited in claim 1, including a knob locking lever for being connected to a locking knob of the vehicle for movement between a locked position and an unlocked position, and said detecting means including a second detecting shaft for detecting the locked position and the unlocked position of the knob locking lever.

6. A vehicle door lock apparatus comprising:

a latch mechanism for establishing a latched condition of a vehicle door;

a first movable locking lever movable between an unlocked position in which the latch mechanism is permitted to be operated and a locked position in which the latch mechanism is prevented from being operated;

a second movable locking lever movable between an unlocked position in which the latch mechanism is permitted to be operated and a locked position in which the latch mechanism is prevented from being operated;

first detecting means for detecting the locked or unlocked position of the first locking lever, the first detecting means including a first detecting shaft on which is mounted the first locking lever so that rotation of the first locking lever results in rotation of the first detecting shaft; and second detecting means for detecting the locked or unlocked position of the second locking lever, the second detecting means including a second detecting shaft on which is mounted the second locking lever so that rotation of the second locking lever results in rotation of the second detecting shaft.

7. A vehicle door lock apparatus as recited in claim 6, wherein the first and second detecting means are disposed in a fluid-tightly sealed housing.

8. A vehicle door lock apparatus as recited in claim 6, wherein said first locking lever is fixedly secured to the first detecting shaft and the second locking lever is fixedly secured to the second detecting shaft.

9. A vehicle door lock apparatus comprising:

a latch mechanism for establishing a latched condition of a vehicle door;

a rotatable locking lever for being connected to a locking element of a vehicle to permit the latch mechanism to be operated and to prevent the latch mechanism from being operated;

an actuator connected with the locking lever for operating the locking lever;

detecting means operatively associated with the locking lever for detecting a locked or unlocked position of the locking lever; and a connector integrally formed on the actuator for relaying a signal output from the detecting means and for receiving electric power to be supplied to the actuator.

10. A vehicle door lock apparatus as recited in claim 9, wherein said locking lever is an actuator locking lever for being connected to a locking knob located inside a vehicle.

11. A vehicle door lock apparatus as recited in claim 9, wherein said connector includes an end at which is exposed an input terminal connected to the actuator for supplying electric power to the actuator and an output terminal connected to the detecting means for relaying a signal output from the detecting means, the end of the connector being adapted to matingly engage another connector.

12. A vehicle door lock apparatus as recited in claim 9, wherein said actuator is positioned within a housing that includes a main body and a cover, the actuator including a motor positioned in the main body, said connector being integrally formed in one piece with the main body.

13. A vehicle door lock apparatus as recited in claim 12, wherein the connector includes an input terminal connected to the motor by first wiring to supply electric power to the motor upon connection of said connector to another connector, said first wiring being formed in the main body.

14. A vehicle door lock apparatus as recited in claim 13, wherein said controller includes an output terminal connected to the detecting means by second wiring for receiving signals output from the detecting means.

* * * * *